United States Patent [19]

Matzinger et al.

[11] 3,942,298

[45] Mar. 9, 1976

[54] METHOD OF AND APPARATUS FOR PACKAGING AN ANNULAR OBJECT

[76] Inventors: August Matzinger; Gottlieb Benz, both of c/o Maschinenfabrik Flums AG, 8890 Flums, Switzerland

[22] Filed: Sept. 25, 1974

[21] Appl. No.: 509,111

Related U.S. Application Data

[63] Continuation of Ser. No. 333,307, Feb. 16, 1973, abandoned.

[30] Foreign Application Priority Data

Feb. 21, 1972 Switzerland ..... 2479/72

[52] U.S. Cl. ..... 53/13; 53/33; 53/204; 53/228

[51] Int. Cl.[2] ..... B65B 11/08

[58] Field of Search ..... 53/13, 30, 32, 33, 204, 53/221, 228, 229, 230, 232, 184, 372; 198/20

[56] References Cited

UNITED STATES PATENTS

| | | | |
|---|---|---|---|
| 2,553,871 | 5/1951 | Sandberg | 53/220 |
| 2,695,483 | 11/1954 | Toews | 53/182 X |
| 2,954,863 | 10/1960 | Staples | 198/20 R X |
| 3,127,722 | 4/1964 | Schoder | 53/230 |
| 3,191,356 | 6/1965 | Zelnick | 53/229 |
| 3,203,543 | 8/1965 | Taylor | 53/13 X |
| 3,564,810 | 2/1971 | Faletti | 53/228 X |
| 3,585,776 | 6/1971 | Euwe | 53/230 X |
| 3,589,913 | 6/1971 | Rosenberg | 53/28 X |
| 3,736,722 | 6/1973 | Rosenberg | 53/204 X |
| 3,766,708 | 10/1973 | Kubo | 53/184 S X |

FOREIGN PATENTS OR APPLICATIONS

| | | | |
|---|---|---|---|
| 2,004,525 | 3/1969 | France | 53/13 |

*Primary Examiner*—Travis S. McGehee
*Assistant Examiner*—John Sipos
*Attorney, Agent, or Firm*—Karl F. Ross; Herbert Dubno

[57] ABSTRACT

An annular object is disposed between upper and lower thermally fusible thermoplastic foils which are pushed together and cut away in an annular weld seam by a pair of tool halves brought vertically together in the central opening of the object. The lower tool half fits between a pair of spaced-apart transport bands which serve to carry the packaged object away after its center is cut out. The object can be supported above the bands on a fork so that the two tool halves can be brought together at a plane in the middle of the thickness of the object. If the object rests on the bands, the upper foil is deformed downwardly to the level of the undeflected bottom foil so that the lower foil is not deformed and ripped.

2 Claims, 11 Drawing Figures

METHOD OF AND APPARATUS FOR PACKAGING AN ANNULAR OBJECT

FIELD OF THE INVENTION

The present invention relates to a method of and an apparatus for forming concentric welds (heat seals) and cut edges in the center of an annular object packaged in thermoplastic foil and, more particularly, to an improved system for packaging an annular object which is preferably flat, in a shrinkable foil.

BACKGROUND OF THE INVENTION

The packaging of annular objects such as automobile tires in thermoplastic synthetic resin foils presents some difficulty. Firstly it has been found to be extremely handy to have the packaging material follow the annular shape of the tire, with a hole in the center i.e. to hug the inner and outer periphery of the packaged object for easiest handling and transport. The removal of the center web, however, is fraught with difficulties since it must be done with accuracy and at the same time rapidly, in the course of production.

OBJECTS OF THE INVENTION

It is therefore an object of the present invention to provide an improved method of and apparatus for removing the center of a package of an annular object.

Another object of the invention is to provide a method of cutting the center out of package, thereby forming an annular or doughnut-shaped package, without puncturing either of the foils.

SUMMARY OF THE INVENTION

These objects are attained in a system of packaging an annular object in which the object is placed between a pair of thermoplastic sheets which are joined together at their leading ends. A two-part tool as described in the copending application Ser. No. 333,306 filed Feb. 16, 1973 now U.S. Pat. No. 3,868,291 is closed on the two sheets at the center of the object to form concentric cuts and welds and remove this center, all without pulling the lower sheet between the support and the object.

According to another feature of this invention the object is supported on a pair of spaced transport elements, belts or chains, which leave the object's center exposed so that the tool can punch out this center. A fork holds the object above these elements during the welding and cutting operation which is carried out in a plane passing horizontally through the center of the object. Thus the lower sheet is not pinched between the object and the transport elements.

In accordance with another feature of this invention the object is placed on the lower sheet on the transport elements and thereafter its center is punched out. In this arrangement the lower tool half is only lifted to the level of the bottom of the object so that the lower sheet is not deformed at all, this deformation taking place in the upper sheet entirely.

DESCRIPTION OF THE DRAWING

The above and other objects, features, and advantages will become apparent from the following with reference to the accompanying drawing in which.

SPECIFIC DESCRIPTION

Figure 1:
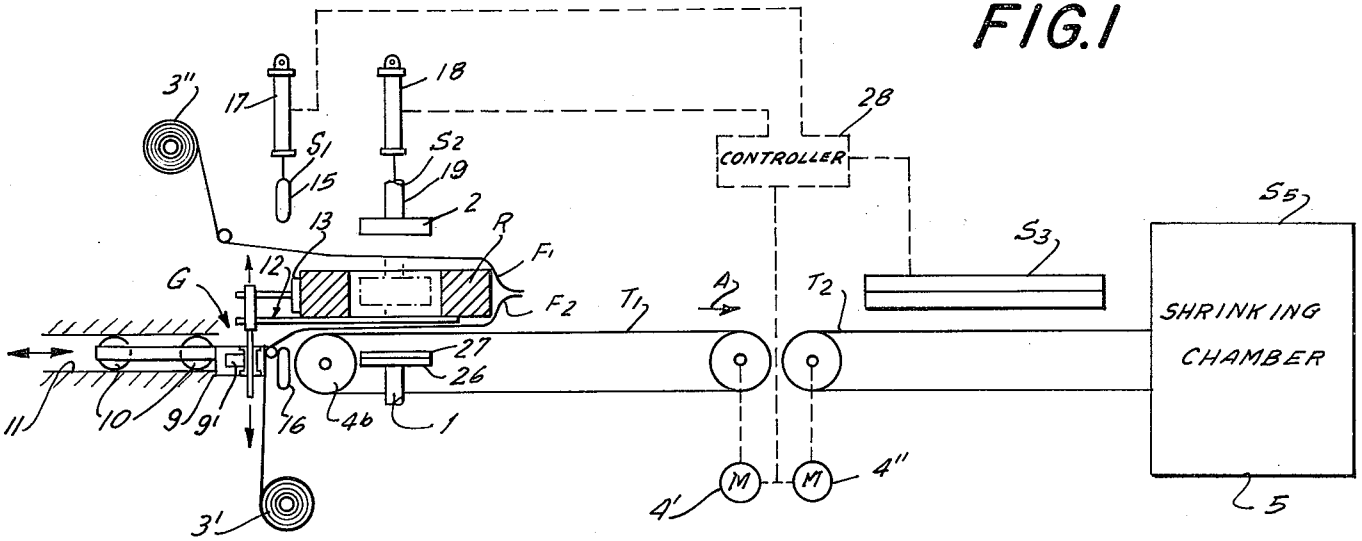
FIG. 1 is a side view of a first embodiment of the present invention.
Figure 2:
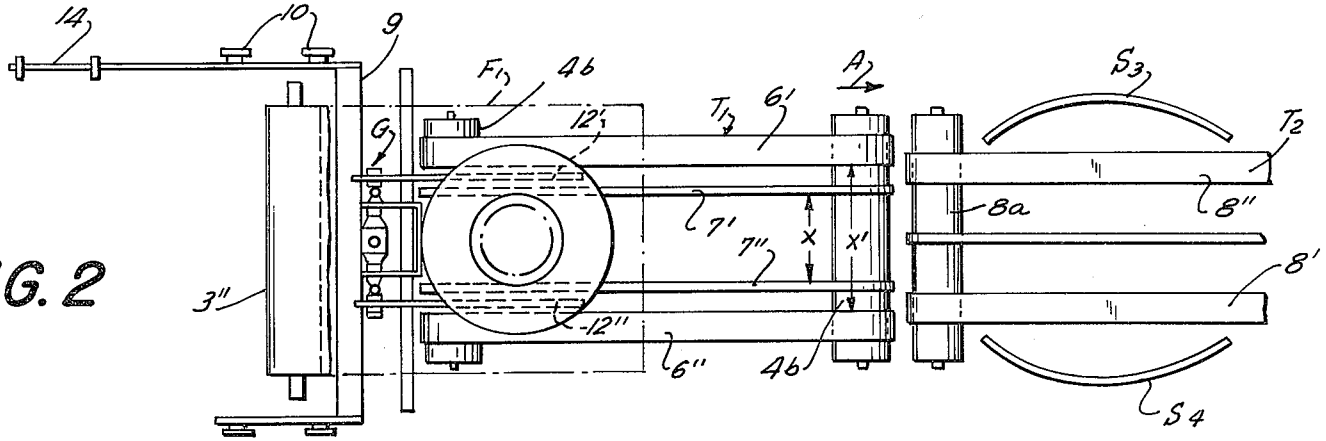
FIG. 2 is a top view of the apparatus of FIG. 1.

As shown in FIGS. 1 and 2 an apparatus for packaging an annular object R between a pair of polyethylene films $F_1$ and $F_2$ has a pair of feed rolls 3' and 3'' for these films, and a pair of transport systems $T_1$ and $T_2$ with respective drives 4' and 4''. There is provided at the first transport system $T_1$ a first welding and cutting station $S_1$ and a station $S_2$ where the center of the package is removed. The second transport system $T_2$ is provided with side welding and cutting devices $S_3$ and $S_4$ and leads into a shrinking tunnel 5 constituting a fifth treatment station $S_5$. A loading arrangement G is provided downstream of the station $S_1$, relative to the transport direction shown by arrow A.

Transport system $T_1$ comprises two relatively wide spaced-apart endless belts 6' and 6'' separated by a distance x' and two relatively narrow spaced-apart belts 7' and 7''. At the downstream end these belts are spanned over respective idler pulleys **4*a* of width corresponding to the belt widths, and at the upstream end over a single drum 4*b* connected to the motor 4'**.

The transport system $T_2$ (FIG. 1) in line with the downstream end of system $T_1$ comprises two outer belts 8', 8'' of the same width as the belts 6' and 6'', but spaced apart by a distance smaller than distance *x'* and greater than distance *x*, with a belt running down the center of the space between these two belts 8'. The belts 8' and 8'' and the center belt are spanned over a common drive drum **8*a* connected to the motor 4''**.

The delivery apparatus G comprises a horizontally displaceable support 9 carried on four wheels 10 riding in a track 11. A fork 12 having a pair of adjustable arms 12' and 12'' and a pusher 13 is vertically displaceable on the support 9 by a motor 9'. The arms 12' and 12'' are adjusted to engage between the belts 6', 7' and 6'', 7'' respectively. These belts are also adjustable transversely to the transport direction A depending on the size of the object R. A horizontal cylinder 14 serves to reciprocate the assembly G in the transport direction A. A device above this unit serves to load objects R onto the form 12.

Figure 5:
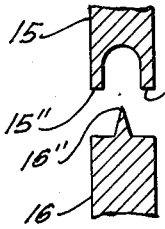
FIG. 5 is a detail of a tool for use in the system of FIG. 1, in enlarged scale.
Figure 3A:
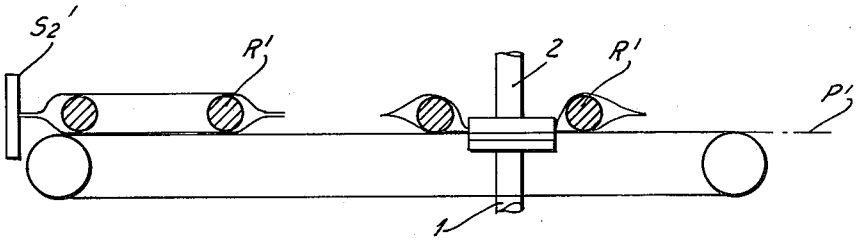
FIGS. 3A and 4A are respectively side and top views of a second embodiment of the present invention.
Figure 4A:
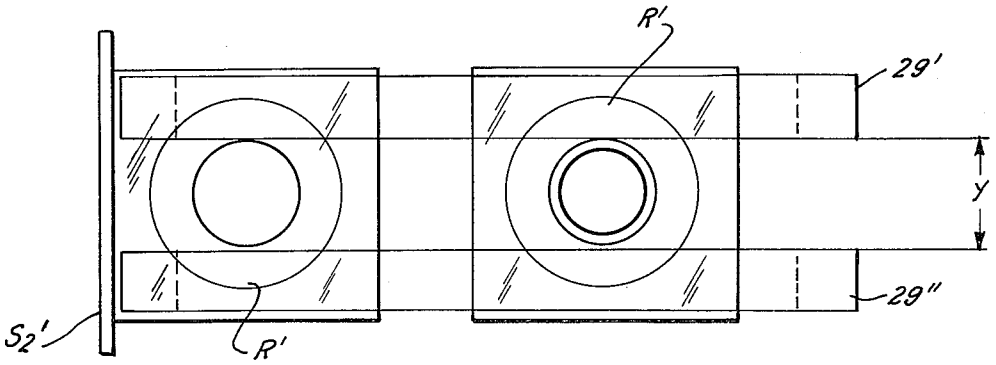
Figure 3B:
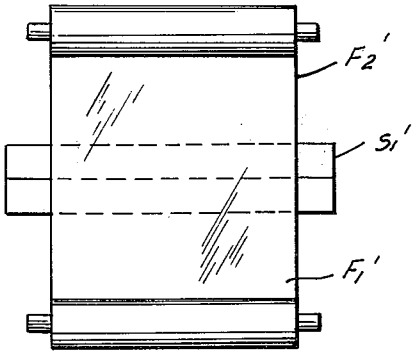
FIGS. 3B and 4B are respectively end and top views of the film feed for the device of FIGS. 3A and 4A.
Figure 4B:
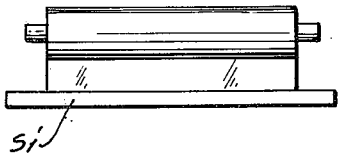

The welding and cutting station $S_1$ comprises a pair of straight bars 15 and 16 shown in detail in FIG. 5 and each carried on a respective hydraulic cylinder 17 for vertical reciprocation. The upper bar 15 is provided with a thermostatically controlled heating element 15' and has two parallel edges 15'' giving it the shape of a downwardly open channel. The lower bar is provided with its own thermostatically controlled heating element 16' and is formed centrally with a longitudinally extending sharp edge that engages between the welding rims 15''. The two bars 15 and 16, when brought together over two separate thermoplastic sheets thus form two spaced-apart welds separated by a cut. These bars 15 and 16 are much wider than the foils $F_1$ and $F_2$. The welders-cutters at stations $S_3$ and $S_4$ are identical to the bars 15 and 16 except that they are arcuate and flank the transport $T_2$.

The station $S_2$ is provided with a pair of tool halves 1 and 2 operated by cylinders 18 (only one shown) and is identical to the system described in the above-cited copending application. The upper half comprises a support 19. The half 2 is lowered down to a plane P and the lower half 1 is raised to this plane for the welding and cutting operation. This lower half is simply a circular platen 26 carrying a silicone rubber disk 27 acting with the half 2 to press together the two foils $F_1$ and $F_2$.

Figure 1A:
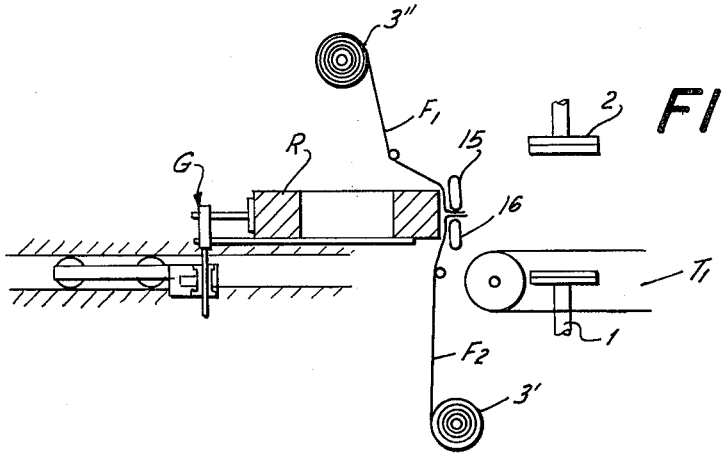
FIGS. 1A – 1D are views similar to FIG. 1 showing the operation of the apparatus.

The device described above functions as follows:

Initially the leading ends of the two films $F_1$ and $F_2$ are welded together and trimmed by the bars 15 and 16 in the station $S_1$ as shown in FIG. 1A. At this time the delivery apparatus G is retracted and the mold halves 1 and 2 are fully separated.

Figure 1B:
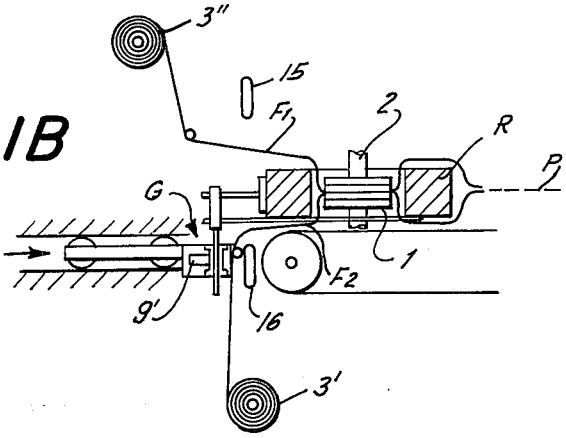

Then as shown in FIG. 1B the bars 15 and 16 are separated and the delivery device G advanced to pull a quantity of film off the rolls 3'' and 3' by pushing the object R against the closed end of these two films $F_1$ and $F_2$. The mold halves 1 and 2 are now brought together to the plane P which lies in the middle of the thickness of the object R. Since this object is still supported above the transport belt system $T_1$, however, their closing simply deforms the two films and pulls them off the reels 3' and 3'' a little more. The halves 1 and 2 cut a circle C out of each of the films at the center of the object R and weld together the edges.

Figure 1C:
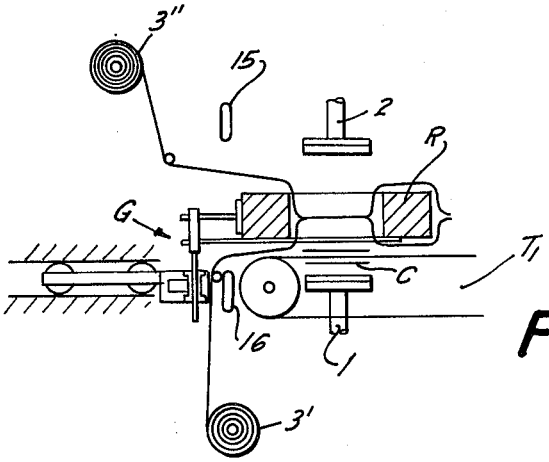

Thereupon as shown in FIG. 1C the two halves 1 and 2 are separated and the delivery fork 12 is dropped down to rest the object on the transport $T_1$. The center portion C drops out and falls through between the belts.

Figure 1D:
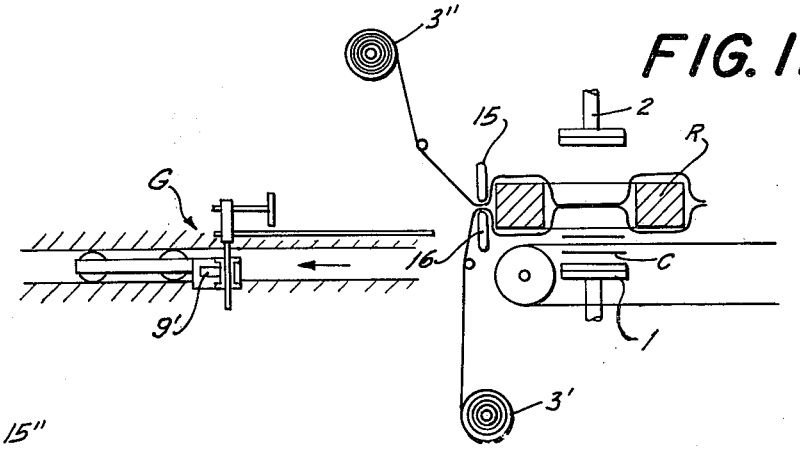

FIG. 1D shows how the delivery apparatus G is now withdrawn and the two bars 15 and 16 are brought together again to cut the object free from the sources of film and allow it to be transported away in direction A by the transport system $T_1$ while closing the end of the films for another such cycle. Thereafter the sides of the package are trimmed off and welded shut by the units $S_3$ and $S_4$ and the now fully closed package is shrunk tight around the tire R in the tunnel 5 by heat. The transport systems operate synchronously and intermittently to advance the object R through these various steps. A controller 28 is provided to operate the culinders 14, 17, and 18 and the motors 4' and 4'' in the order described above.

This arrangement forms a very tight package around an annular object while leaving a hole in its center for easiest transport and handling. Since the object R is held in the air by the fork during the operation when its center is punched out and sealed, the lower film is not damaged by being pulled between the object and the support on which it rests, clearly since the film passes under the fork 12. The belts of transport device $T_1$ are spaced so as to allow the lower half 1 to pass up to a level above them so as to make a completely uniform package.

FIGS. 3A, 3B, 4A, and 4B show another version of the present invention where an object R' is first completely enclosed between two foils $F_1'$ and $F_2'$. The round central welding and cutting operation is formed in a station $S_3'$ after the ends and sides of the two films have been joined together and trimmed in stations $S_1'$ and $S_2'$. In this case, however, the center is cut out when the object R' is lying on transport belts 29' and 29'' spaced apart by a distance *y* to accommodate the two stamp halves 1 and 2. The lower half 1 is only lifted to a plane P' level with the bottom of the object or the foil $F_1'$ so that once again the lower foil is not pulled between the object and its support and damaged.

We claim:

1. A method of packaging a massive annular object comprising the steps of, in succession:

a. supporting said annular object in a substantially horizontal plane on a pair of arms parallel to a transport direction and spaced apart by a distance greater than the central opening of said object above a transport path extending in said direction;

b. sealing an upper sheet and a lower sheet of thermoplastic material together at the leading side of said object in said direction;

c. passing said upper sheet over said object and said lower sheet under said object and said arms, so that said lower sheet lies between said transport path and said arms;

d. deforming said upper sheet downwardly into said opening and said lower sheet upwardly into said opening so that said sheets meet within said opening at substantially a median location between the top and bottom of the object;

e. forming an annular seam around the perimeter of said opening between the meeting sheets and an annular cut within said annular seam;

f. lowering said object onto said path and supporting said object therein by said lower sheet upon a pair of spaced-apart bands extending along said transport path;

g. withdrawing said arms from between said lower sheet and said object;

h. displacing said object and said sheets on said bands in said direction; and i. sealing said sheets together along a trailing side of said object.

2. An apparatus for packaging a massive annular object between a pair of thermoplastic sheets, comprising:

a. a pair of spaced-apart transport bands extending in and displaceable in a transport direction and defining a transport path;

b. a fork having a pair of arms extending in said direction and transversely spaced by a distance greater than the width of said opening and adapted to extend over said path to support said object above said bands;

c. means for applying an upper thermoplastic sheet to the top of said object and a lower thermoplastic sheet to the bottom of said object between said fork and said bands;

d. an upper plunger and a lower plunger adapted to press said upper sheet and said lower sheet together substantially to a median location in the height of said object within said opening and between said arms while the object is supported by said arms, said plungers being provided with means forming an annular heat seal seam in the pressed-together sheets within said opening, and cutting said sheets within said seal;

e. means for retracting said arms from between said lower sheet and said object, thereby depositing said object upon said bands on which said object rests via said lower sheet;

f. means for displacing said bands to move said object in said direction; and g. means for heat-sealing said sheets together at a leading side and a trailing side of said object.

* * * * *